US008789661B2

(12) United States Patent
Barth

(10) Patent No.: US 8,789,661 B2
(45) Date of Patent: Jul. 29, 2014

(54) VISUAL WARNING BARRIER FOR DOOR ASSEMBLY USED IN A VERTICAL LIFTING SYSTEM

(75) Inventor: Gene M. Barth, Glendale, WI (US)

(73) Assignee: Pflow Industries Inc., Milwaukee, WI (US)

( * ) Notice: Subject to any disclaimer, the term of this patent is extended or adjusted under 35 U.S.C. 154(b) by 266 days.

(21) Appl. No.: 13/246,946

(22) Filed: Sep. 28, 2011

(65) Prior Publication Data

US 2013/0075202 A1 Mar. 28, 2013

(51) Int. Cl.

| | |
|---|---|
| ***B66B 13/02*** | (2006.01) |
| ***B66B 13/14*** | (2006.01) |
| ***B66B 13/28*** | (2006.01) |
| ***E06B 7/00*** | (2006.01) |

(52) U.S. Cl.
USPC ..... 187/325; 187/314; 187/400; 49/50

(58) Field of Classification Search
USPC ..... 187/314, 325, 326, 332, 336, 340, 341, 187/342, 400; 49/50, 54, 56; 52/30, 64, 52/105, 204.1
IPC ..... B66B 13/24,13/28
See application file for complete search history.

(56) References Cited

U.S. PATENT DOCUMENTS

| | | | | | |
|---|---|---|---|---|---|
| 382,037 | A * | 5/1888 | Greenman | 187/326 |
| 429,932 | A * | 6/1890 | Mathews et al. | 187/326 |
| 536,001 | A * | 3/1895 | Sullivan | 187/331 |
| 621,670 | A * | 3/1899 | Hinds | 187/325 |
| 679,614 | A * | 7/1901 | Fleming | 187/331 |
| 812,814 | A * | 2/1906 | Brown et al. | 187/326 |
| 1,064,791 | A * | 6/1913 | Underwood | 187/329 |
| 1,135,279 | A * | 4/1915 | Hater | 187/329 |
| 1,320,201 | A * | 10/1919 | Cederstrom et al. | 187/321 |
| 1,321,697 | A * | 11/1919 | Alfano | 187/330 |
| 1,573,770 | A * | 2/1926 | Lucas | 109/18 |
| 1,593,536 | A * | 7/1926 | McClees | 109/18 |
| 1,632,506 | A * | 6/1927 | Robinson | 187/332 |
| 4,437,265 | A * | 3/1984 | Turro et al. | 49/57 |
| 4,590,706 | A * | 5/1986 | Plowman | 49/57 |
| 4,982,814 | A * | 1/1991 | Hussey | 49/57 |
| 5,205,379 | A | 4/1993 | Pfleger | |
| 5,228,537 | A | 7/1993 | Pfleger et al. | |
| 5,773,771 | A | 6/1998 | Chatham | |
| 5,941,347 | A | 8/1999 | Pfleger et al. | |
| 6,360,848 | B1 | 3/2002 | Barth | |
| 7,114,594 | B2 * | 10/2006 | Rossignol et al. | 187/336 |
| 8,544,611 | B2 * | 10/2013 | Ogava | 187/314 |
| 2008/0078624 | A1 | 4/2008 | Webster | |
| 2010/0119338 | A1 | 5/2010 | Webster et al. | |

* cited by examiner

*Primary Examiner* — William E Dondero
*Assistant Examiner* — Minh Truong
(74) *Attorney, Agent, or Firm* — Andrus Intellectual Property Law, LLP

(57) ABSTRACT

A vertical reciprocating conveyor has a carriage mounted for movement in a support frame between different designated vertical levels, a door assembly mounted on the support frame for gaining access to the carriage when the carriage is at the one designated level. A visual warning barrier is movably mounted between a raised, inoperative position and a lowered, operative position across a doorway formed in the support frame at the one designated level. The visual warning barrier is automatically moved from the raised, inoperative position to the lowered, operative position upon movement of the door assembly to the open position when the carriage is located away from the one designated level.

15 Claims, 4 Drawing Sheets

VISUAL WARNING BARRIER FOR DOOR ASSEMBLY USED IN A VERTICAL LIFTING SYSTEM

FIELD OF THE INVENTION

The present disclosure relates generally to a safety arrangement for use with a vertical lifting system that moves cargo on a carriage between two or more different levels. More specifically, the present disclosure pertains to a vertical lifting system, such as a vertical reciprocating conveyor, employing an access door and a door locking assembly, and a visual warning barrier that provides supplemental protection if the door locking assembly fails to properly operate.

BACKGROUND OF THE INVENTION

A typical vertical reciprocating conveyor includes a carriage having a deck or platform to support cargo as the carriage is guided for vertical movement by an actuating mechanism in a shaft of a support frame that includes a set of vertical support columns interconnected by side guards, such as enclosure panels, walls or the like. A vertical reciprocating conveyor typically employs a movable door for gaining access to the carriage through a door opening, and an electromechanical door lock for controlling the opening and the closing of the door depending upon the vertical position of the carriage. The door lock normally operates to prevent the door from being opened unless the carriage is at a designated loading/unloading level, and also prevents carriage movement if any door is not fully closed or locked. The door lock is designed to maintain closure of the door to prevent against accidental falls of personnel, cargo and equipment into an open shaft of the support frame when the carriage has moved away from the designated loading/unloading level. In the event of failure of the door lock, such as caused by damage thereto or malfunction thereof, an undesired door opening can create a severe safety hazard, particularly in poorly lighted areas.

Therefore, it is desirable to provide an extra measure of protection for a door opening or frame on a vertical reciprocating conveyor in the form of a visual warning barrier that is automatically deployed across the door opening to warn against entry into an open shaft of a vertical reciprocating conveyor in the event of a failed door lock.

SUMMARY OF THE INVENTION

The present disclosure relates to a safety arrangement for use with a vertical reciprocating conveyor having a carriage mounted for movement in a support frame between different designated vertical levels, and a door assembly mounted on the support frame at one of the designated levels for gaining access to the carriage when the carriage is at the one designated vertical level. The door assembly includes a door or doors that are movable between an open position and a closed position. A door lock is mounted on the support frame for normally allowing the door assembly to move to the open position only when the carriage is located at the one designated level, and for normally maintaining the door assembly in the closed position when the carriage is located away from the one designated level.

A visual warning barrier is movably mounted within guide tracks mounted to the door frame. The visual warning barrier is movable between a raised, inoperative position and a lowered, operative position across a doorway including the support frame at the one designated level. The visual warning barrier is automatically moved from the raised, inoperative position to the lowered, operative position upon an undesired movement of the door assembly to the open position when the carriage is located away from the one designated level.

In the example disclosed, the support frame includes a door frame having a pair of vertical side members provided with guide tracks and connected at upper ends thereof by a transverse header. The visual warning barrier is an elongated bar having opposite ends slidably supported in the guide tracks. The guide tracks are provided with upper stops and lower stops defining limits of vertical travel of the elongated bar. The opposite ends of the elongated bar are engageable with the upper stops at the raised, inoperative position, and engageable with the lower stops at the lowered, operative position. The elongated bar is held in the raised, inoperative position by a holding assembly, which may be an electromagnet assembly, an electro-mechanical assembly or a completely mechanical assembly connected to the header. In one embodiment, an underside of the elongated bar is engaged with a support element connected to the door assembly when the door assembly is in the closed position. The underside of the elongated bar is disengaged from the support element when the door assembly is moved to the open position. When the carriage is not present at the level where the door assembly is opened, de-energization of the electromagnet allows the elongated bar to drop by gravity to the lowered, operative position. The elongated bar is manually returned to the stored, inoperative position and is supported in this position by the support element on the door assembly when the door assembly is closed. The elongated bar includes a metal sleeve that is magnetically engageable with the electromagnet when the electromagnet is energized.

In an alternate embodiment, the electromagnet assembly is energized to hold the elongated bar in the raised, inoperative position when the door assembly is in the closed position and the carriage is either present or not present at the level including the safety arrangement. When the doors at the level open, the electromagnet assembly remains energized only when the carriage is at the same level. If the carriage is not at the level when the doors open, the electromagnet assembly is de-energized allowing the elongated bar to fall. The electromagnet assembly is only re-energized when the carriage is moved to the level including the safety assembly.

Although an electromagnet assembly is contemplated as forming the holding assembly in several embodiments of the disclosure, the electromagnet assembly could be replaced by other mechanical devices that can be controlled to hold or release the elongated bar on demand. As an illustrative example, the electromagnet assembly could be replaced by an electro-mechanical assembly or a completely mechanical assembly that can be activated and de-activated to allow the elongated bar to drop when the doors are open and the carriage is not present at the level where the door assembly is opened.

BRIEF DESCRIPTION OF THE DRAWINGS

The drawings illustrate the best mode currently contemplated of carrying out the present invention.

In the drawings.

DETAILED DESCRIPTION

Figure 1B:
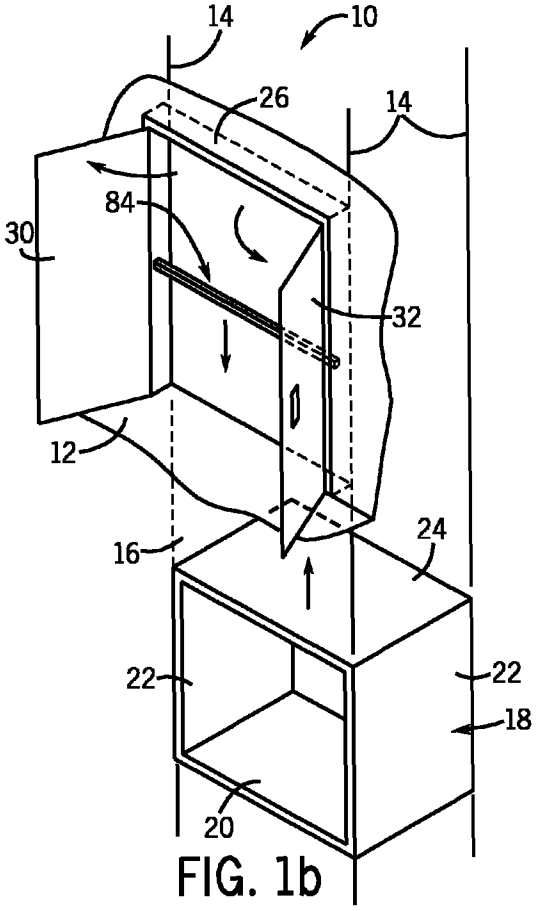
FIG. 1*b* is a representation similar to FIG. 1, but showing an undesired opening of the pair of doors such that the visual warning barrier will move to a lowered, operative position to warn against entry into the shaft.
Figure 1A:
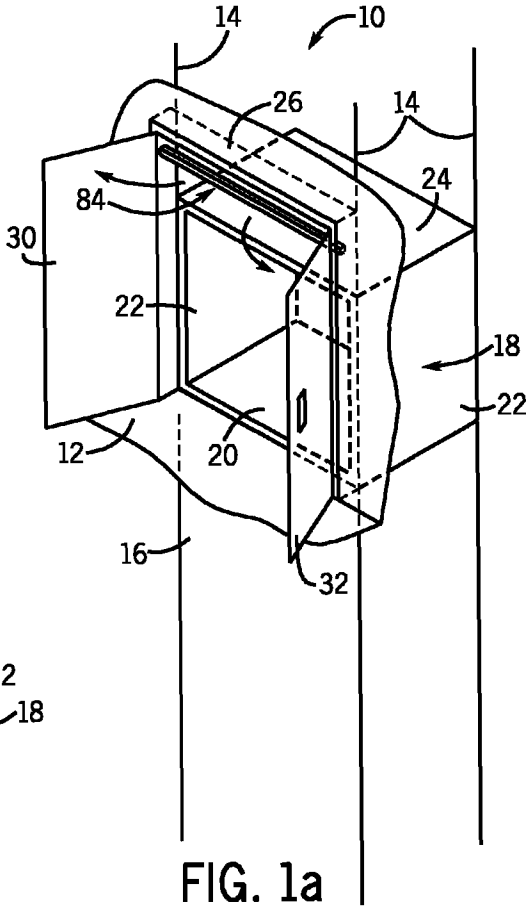
FIG. 1*a* is a representation similar to FIG. 1, but showing the carriage raised to the designated loading/unloading level such that the door lock assembly will permit opening of the pair of doors to access the carriage with the visual warning barrier remaining in the stored, inoperative position.
Figure 1:
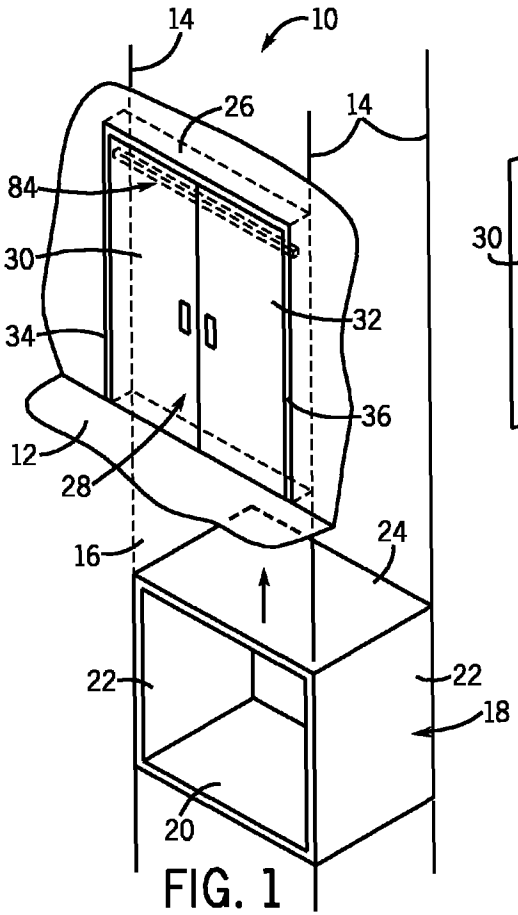
FIG. 1 is a pictorial representation of a vertical lifting system having a carriage being raised in a shaft defined by a support frame from a lower level to a designated upper loading/unloading level behind a door assembly having a pair of doors normally held closed by a door lock assembly and showing a visual warning barrier according to the present disclosure in an uppermost, stored, inoperative position.

Referring now to the drawings and in particular FIGS. 1, 1*a* and 1*b*, thereshown is a vertical lifting system in the form of a vertical reciprocating conveyor 10 that is adapted to convey cargo between different vertical levels, such as a designated loading/unloading level 12 of a building. The conveyor 10 includes a support frame that consists of a set of vertical support columns 14 interconnected by enclosure panels, walls or the like to define a conveyor passageway or shaft 16. Alternatively, the vertical reciprocating conveyor could be utilized only with the support frame without any enclosure panels such that the vertical reciprocating conveyor would be open and not enclosed.

The conveyor 10 is provided with a carriage 18 that is adapted to be driven by a suitable actuating mechanism, and moved upwardly and downwardly within the shaft 16 to various vertical levels relative to the level 12. The carriage 18 includes a deck or platform 20 that is adapted to support a load or cargo, a pair of side guards 22 that extend upwardly from the platform 20, and a top wall 24 that joins the upper ends of the side guards 22. The carriage 18 is open at front and rear side thereof to permit loading/unloading from opposite sides of the conveyor 10 when the carriage 18 is at various vertical unloading/loading levels.

The support frame defined by vertical support columns 14 includes a door frame 26 for mounting a protective door assembly 28 used in gaining access to the carriage 18 when the carriage 18 is positioned at the level 12. In the drawings, the door assembly 28 is shown as a pair of biparting doors 30, 32 which are hingedly mounted on opposite side edges 34, 36, respectively, of the door frame 26 so that the doors 30, 32 may be swung open and closed outside shaft 16 about respective vertical axes. It should be understood however, that the door assembly 28 may be constructed of other suitable closure configurations.

Figure 2:
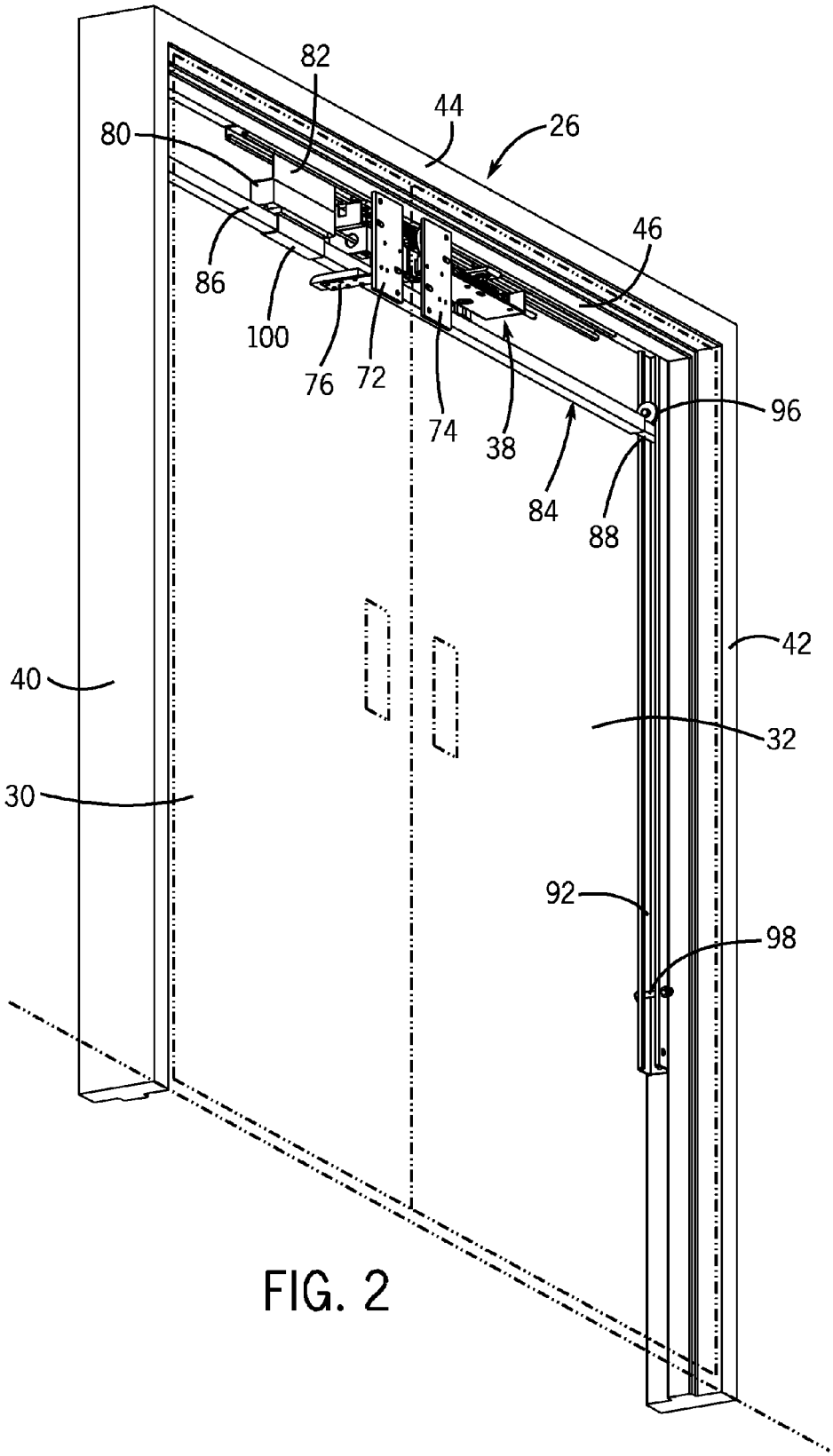
FIG. 2 is enlarged, front perspective view of the door assembly of FIG. 1 showing the visual warning barrier mounted behind a pair of biparting doors shown in phantom.
Figure 3:
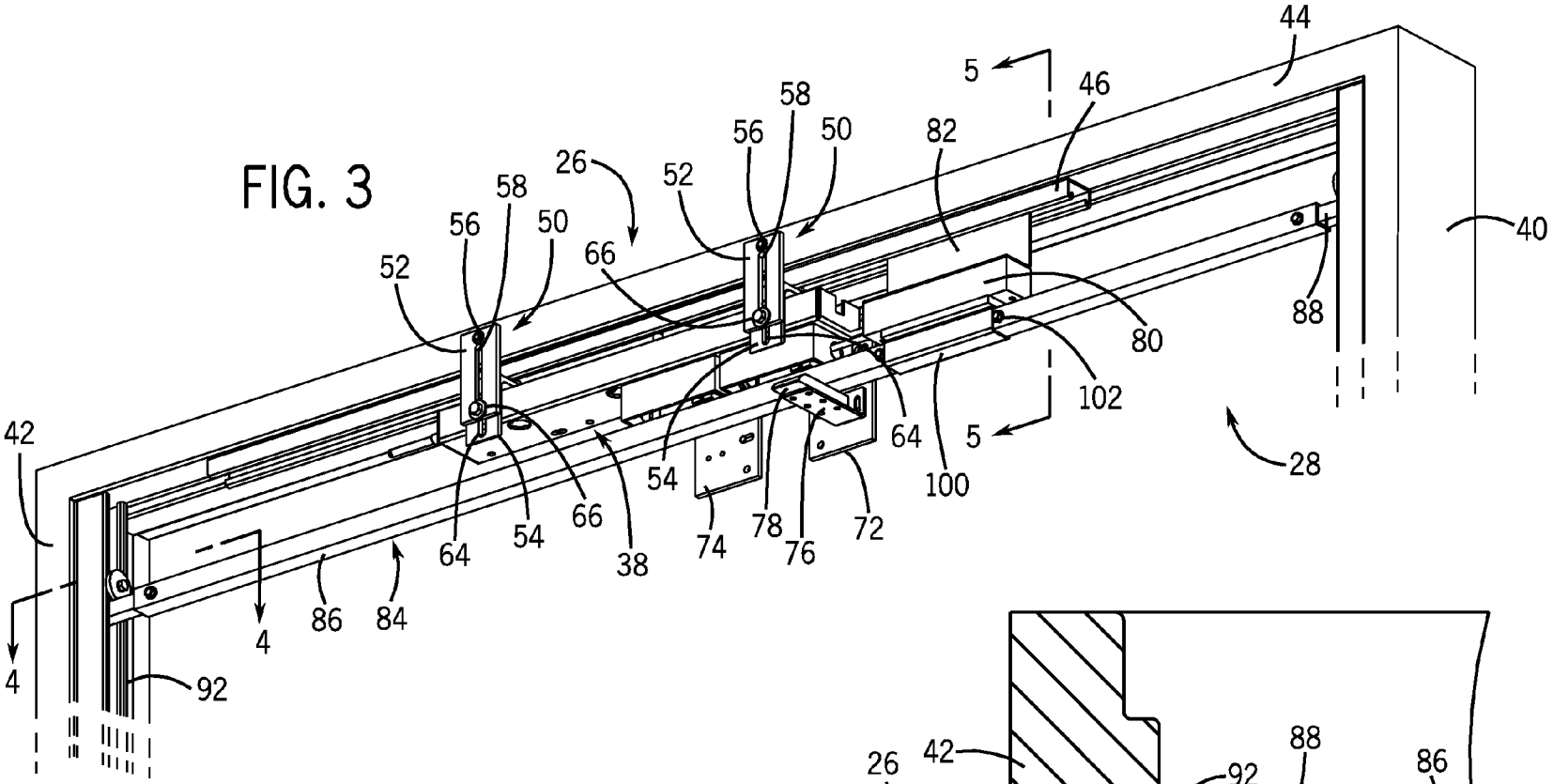
FIG. 3 is an enlarged fragmentary rear view of the visual warning barrier in the stored, inoperative position.

With reference to FIGS. 2 and 3, an uppermost end of the door frame 26 is provided with an electromechanical door lock assembly 38 which is designed to prevent the doors 30, 32 from being opened unless the carriage 18 is at a designated level, such as level 12, and also prevents carriage movement if the door assembly 28 is not fully closed.

Figure 5:
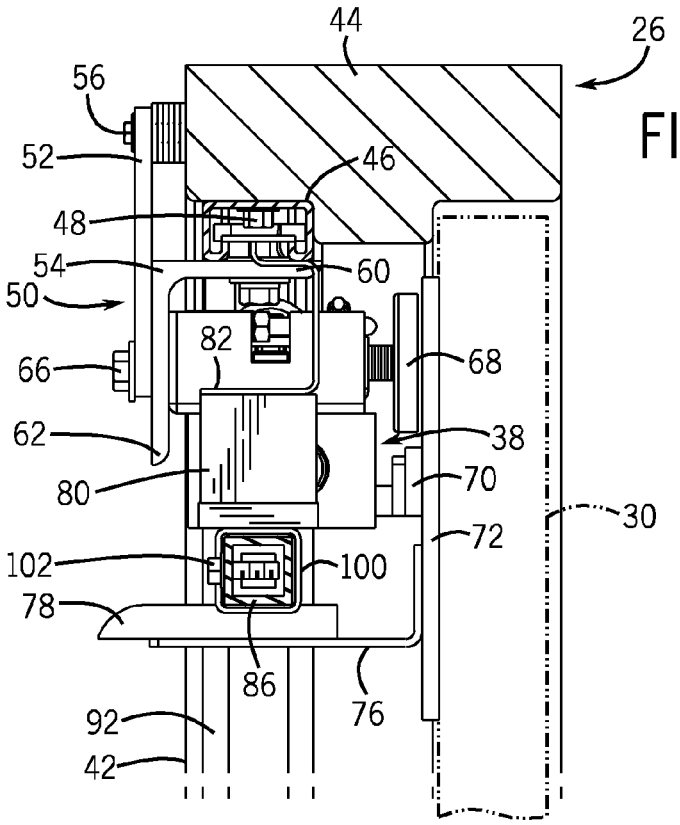
FIG. 5 is a sectional view taken on line 5-5 of FIG. 3.

Door frame 26 is an inverted U-shaped structure having a pair of spaced apart vertical side members 40, 42 interconnected at upper ends thereof by a transverse header 44. The vertical side members 40, 42 include the opposite side edges 34, 36 to which the doors 30, 32 are pivotally connected. An elongated mount channel 46 extends partially along the length of an underside of the header 44, and is fixed to a rear recessed portion thereof by fasteners, one of which is shown at 48 in FIGS. 5 and 6. The door lock assembly 38 is adjustably suspended from the underside of header 44 by a pair of bracket assemblies 50. Each bracket assembly 50 includes a generally rectangular attachment plate 52, and an angled mounting bracket 54 which is engaged behind the attachment plate 52.

An upper end of the attachment plate 52 is secured to a rear surface of the header 44 by a fastener 56, and a vertically extending slot 58 is formed longitudinally through the attachment plate 52. The angled mounting bracket 54 has a horizontal leg 60 connected to the door lock assembly 38, and a vertical leg 62 formed with a vertically extending slot 64 aligned with the slot 58 in the attachment plate 52. A fastener 66 is passed through the aligned slots 58, 64 and into door lock assembly 38 and may be tightened and loosened to adjust the vertical position of door lock assembly 38 beneath the header 44. The door lock assembly 38 is mounted so that certain working elements 68, 70 thereof are appropriately positioned relative to a pair of interlock keeper plates 72, 74 secured to upper and inner ends of the doors 30, 32. A lower end of the keeper plate 72 is provided with a support bracket 76 having a support element 78 mounted thereon. An electromagnet assembly 80 is located outside one end of the door lock assembly 38 and includes a hanger 82 that is connected to the mount channel 46.

Figure 4:
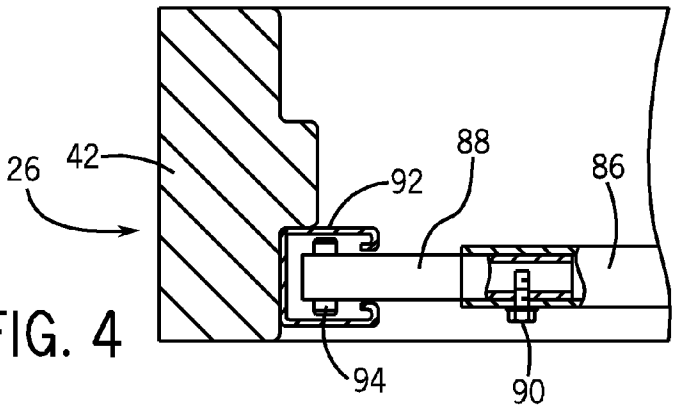
FIG. 4 is a sectional view taken on line 4-4 of FIG. 3.

A horizontally extending visual warning barrier 84 is movably mounted behind the door assembly 28 for vertical travel relative to the door frame 26 between a stored, inoperative position beneath the door lock assembly 38 as shown in FIGS. 1, 1*a*, 2, 3 and 5, and a lowered, operative position as depicted in FIG. 1*b*. The visual warning barrier 84 is defined by an elongated, tubular safety bar 86 provided with extensions 88 that are slidably received in opposite open ends of the safety bar 86 and connected thereto by fasteners 90. Outer ends of the extensions 88 project into guide tracks 92 which run vertically along inside surfaces of the door frame side members 40, 42, one extension 88 being shown in FIG. 4. The outer ends of the extensions 88 carry roller elements 94 which travel inside the guide tracks 92. As illustrated in FIG. 2, each guide track 92 is provided with an upper stop member 96 and a lower stop member 98 which establish the limits of vertical travel for the safety bar 86. A metal sleeve 100 surrounds a portion of the safety bar 86 and is held in position thereon beneath the electromagnetic assembly 80 by fasteners 102. The electromagnet assembly 80 functions as a holding assembly to magnetically hold the sleeve 100 and the safety bar 86 in the stored, inoperative position when the movable carriage is at the level including the electromagnet assembly 80 and the doors 30, 32 are opened. The support element 78 is normally engageable with the underside of safety bar 86 when the door 30 is closed to hold the safety bar 86 in the position shown.

Although the electromagnet assembly 80 is shown in the Figures as comprising the holding assembly to hold the safety bar 86 in the stored, inoperative position, it is contemplated that in other alternate embodiments, various other types of holding assemblies could be utilized while operating within the scope of the present disclosure. As one illustrative example, the electromagnet assembly 80 could be replaced with an electro-mechanical assembly that includes an electric actuator and mechanical pin to hold the safety bar 86 in the stored, inoperative position. In such an embodiment, the electro-mechanical assembly can be selectively activated and deactivated to allow the safety bar 86 to move between the stored, inoperative position and the released, operative position. Further, the holding assembly could be replaced with a completely mechanical assembly that would also allow the safety bar 86 to move between the stored and released positions as desired. In each case, the holding assembly is selectively activated and de-activated to allow the movement of the safety bar in the manner to be described in greater detail below.

Operation

Referring to FIG. 1, when the carriage 18 is moved such as upwardly in the shaft 16 of the conveyor 10 towards the level 12, the door lock assembly 38 normally operates to maintain the doors 30, 32 in a closed position so that the doors cannot be opened. In the embodiment shown in FIG. 3, when the carriage 18 is not present, the electromagnet assembly 80 is de-energized and the support element 78 on the doors 30, 32 holds the visual warning barrier 84 in its uppermost, stored, inoperative position.

Referring back to FIG. 1, when the carriage 18 reaches the level 12 and is aligned behind the doors 30, 32, the carriage 18 activates a switch (not shown) at the level 12. When the doors 30, 32 are closed, the doors 30, 32 each activate an additional switch mounted to the door frame. When either of the doors open, the corresponding door switch is de-activated. When the carriage switch is de-activated (carriage not at the level) and the door switch is de-activated (either door is not closed), the holding assembly de-activates, releasing the visual warning barrier 84. Under all other conditions (carriage is at the level or both doors closed), the electromagnet assembly 80 is energized to hold visual warning barrier 84 in its stored, inoperative position above the carriage 18.

Figure 6:
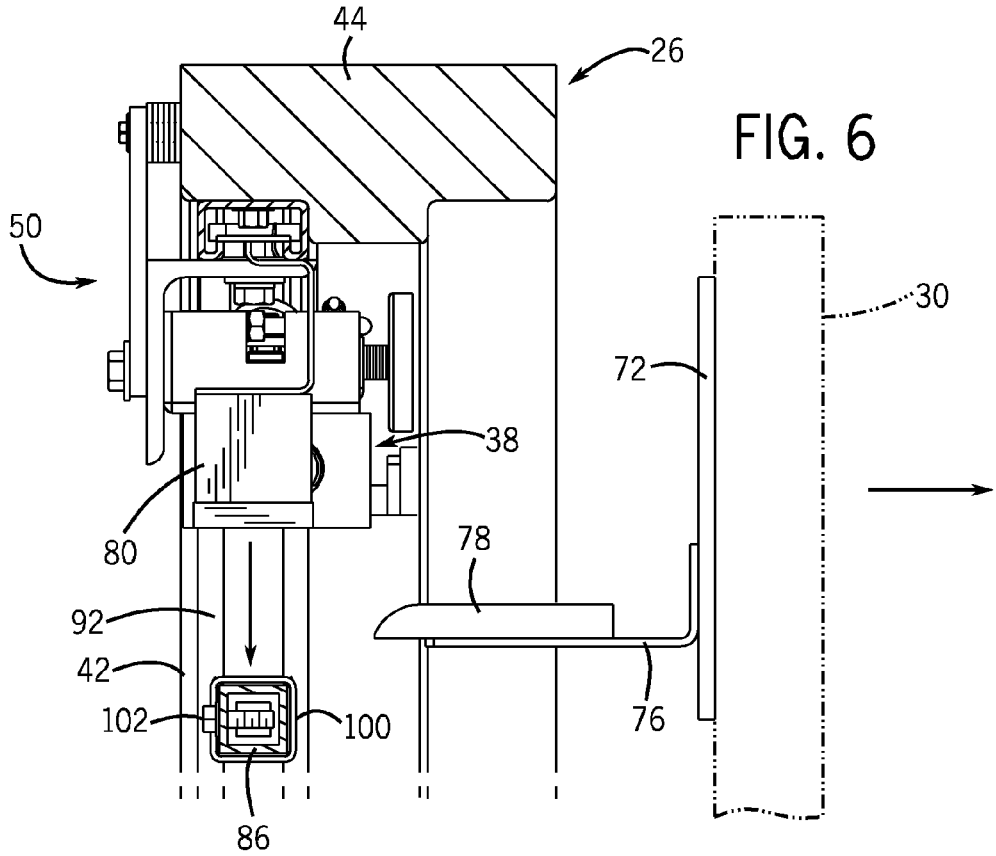
FIG. 6 is a sectional view similar to FIG. 5 but showing an undesired opening of the pair of doors so as to activate lowering of the visual warning harrier.

When the carriage 18 is in transit within the shaft 16 and the door lock assembly 38 should fail such as due to damage or malfunction, an undesired opening of the doors 30, 32 may occur as depicted in FIG. 1*b*. The undesired opening of the doors 30, 32 creates a severe safety hazard as an open shaft 16 of the conveyor 10 is exposed. When the doors 30, 32 open and the carriage 18 is not present at the level including the doors, the carriage switch is not detecting the presence of the carriage such that the electromagnet assembly 80 is de-energized and the undesired opening of the door 30 moves the support element 78 away from the underside of safety bar 86 so that the visual warning barrier 84 drops downwardly by gravity in guide tracks 92 as shown in FIG. 6 towards the lowered, operative position shown in FIG. 1*b*. In the lowered, operative position, the visual warning barrier 84 extends across the door frame 26 and provides a visual deterrent to warn against entry into the open shaft 16.

As can be understood by the foregoing description, the visual warning barrier 84 is held in its stored, inoperative position by the electromagnet assembly 80 only when the carriage 18 activates a switch indicating the presence of the carriage at the floor with the visual warning barrier 84 and one of the doors 30, 32 moves away from the door switch mounted to the door frame. Thus, the electromagnet assembly 80 is energized to retain the visual warning barrier 84 in its stored, inoperative position when the carriage is at the proper level and one or more of the doors are opened. If the carriage 18 is not at the proper level, the carriage switch remains de-activated and the electromagnet assembly 80 will not be energized. If the electromagnet assembly 80 is not energized, when the door including the support element moves away, safety bar 86 falls due to the weight of gravity to provide a visual indication that the carriage is not present to hopefully prevent a user from entering into the conveyor shaft.

Once the safety bar 86 has fallen to its lower, operative position, the safety bar 86 must be manually moved to the stored, inoperative position. The electromagnet assembly 80 will only be energized to hold the safety bar 86 in this position when the carriage is at the proper level. Alternatively, if the carriage is not at the proper floor when the safety bar is moved to its upper, stored position, the doors 30, 32 must be closed such that the support element 78 supports the safety bar 86 in the position shown in FIG. 3.

In the first embodiment described above, the electromagnet assembly 80 is energized only when the carriage is at the proper level and one or more of the doors 30, 32 is opened. In this manner, the amount of time the electromagnet assembly 80 is energized is held at a minimum to extend the life of the electromagnet.

In a contemplated alternate embodiment, the system can be configured in a different way to eliminate the need for the support element 78 shown in FIG. 3. In such an embodiment, the safety bar 86 would be held in its uppermost, stored, inoperative position by the electromagnet. In the alternate embodiment, the electromagnet assembly 80 is energized and holds the safety bar 86 in its uppermost, stored, inoperative position, whenever the carriage is not at the level and both of the doors at the level are fully closed. Thus, if the doors are closed, the electromagnet will be active and hold the safety bar 86 in the position shown in FIG. 3. Likewise, if the carriage is present at the desired level, the electromagnet assembly 80 will be active to hold the safety bar 86 in the uppermost position. The electromagnet assembly 80 will be de-energized only if both the carriage switch and the door switch are not activated, such as if the carriage is not present at the desired level and one or more of the doors 30, 32 are open.

The present disclosure thus provides an automatically activated safety barrier for a vertical reciprocating conveyor and serves as backup protection in the event of failure to the door lock assembly by providing a visual warning. Together, the interlock assembly and the warning barrier define a safety arrangement useful in preventing accidents during operation of the vertical reciprocating conveyor.

Various alternatives are contemplated as being within the scope of the following claims particularly pointing out and distinctly claiming the subject matter regarded as the invention.

What is claimed is:

1. In a vertical reciprocating conveyor having a carriage mounted for movement in a support frame between different designated vertical levels, a door assembly mounted on the support frame at one of the designated levels for gaining access to the carriage when the carriage is at the one vertical level, and moveable between an open position and a closed position relative to a doorway formed in the support frame at the one designated level, the improvement comprising:

a door frame having a pair of vertical side members provided with guide tracks and connected at upper ends thereof by a transverse header;

a visual warning barrier including an elongated bar having opposite ends slidably supported in the guide tracks, wherein the visual warning barrier is movable between a raised, inoperative position and a lowered, operative position in which the visual warning barrier extends across the doorway to warn against entry therethrough, the warning barrier moving from the raised, inoperative position to the lowered, operative position upon movement of the door assembly to the open position when the carriage is located away from the one designated level; and an electromagnetic assembly connected to the header and operable to hold the elongated bar in the raised, inoperative position.

2. The improvement of claim 1, wherein the guide tracks are provided with upper stops and lower stops defining limits of vertical travel of the elongated bar.

3. The improvement of claim 2, wherein the opposite ends of the elongated bar are engageable with the upper stops at the raised, inoperative position, and engageable with the lower stops at the lowered, operative position.

4. The improvement of claim 2, wherein the underside of the elongated bar is disengaged from the support element when the door assembly is moved to the open position and where de-energization of the electromagnet assembly allows the elongated bar to drop by gravity to the lowered, operative position.

5. The improvement of claim 1, wherein an underside of the elongated bar is engaged with a support element connected to the door assembly when the door assembly is in the closed position.

6. The improvement of claim 1, wherein the elongated bar includes a metal sleeve which is magnetically engageable with the electromagnetic assembly.

7. A safety arrangement for use with a vertical reciprocating conveyor having a carriage mounted for movement in a support frame between different designated vertical levels, and a door assembly mounted on the support frame on at least one of the designated vertical levels for gaining access to the carriage when the carriage is at the at least one designated vertical level, the door assembly being movable between an open position and a closed position, the safety arrangement comprising:

a door frame having a pair of vertical side members provided with guide tracks and connected at upper ends thereof by a transverse header;

a visual warning barrier including an elongated bar having opposite ends slidably supported in the guide tracks, wherein the visual warning barrier is movably mounted between a raised, inoperative position and a lowered, operative position in which the elongated bar extends across the door frame at the one designated level, the warning barrier being automatically moved from the raised, inoperative position to the lowered, inoperative position upon movement of the door assembly to the open position when the carriage is located away from the one designated level; and an electromagnetic assembly connected to the header and operable to hold the elongated bar in the raised, inoperative position.

8. The safety arrangement of claim 7, wherein the guide tracks are provided with upper stops and lower stops defining limits of vertical travel of the elongated bar.

9. The safety arrangement of claim 8, wherein the opposite ends of the elongated bar are engageable with the upper stops at the raised, inoperative position, and engageable with the lower stops at the lowered, operative position.

10. The safety arrangement of claim 7, wherein an underside of the elongated bar is engaged with a support element connected to the door assembly when the door assembly is in the closed position.

11. The safety arrangement of claim 10, wherein the underside of the elongated bar is disengaged from the support element when the door assembly is moved to the open position, and de-energization of the electromagnet assembly allows the elongated bar to drop by gravity to the lowered, operative position.

12. The safety arrangement of claim 7 further comprising a door interlock assembly mounted on the supporting guide structure for normally allowing the door assembly to move to the open position when the carriage is located at the one designated level, and for normally maintaining the door assembly in the closed position when the carriage is located away from the one designated level.

13. A vertical reciprocating conveyor comprising:

a supporting guide structure defined by a set of vertical columns;

a carriage mounted for movement in a passageway formed in the supporting guide structure between different vertical levels;

a door frame having a pair of vertical side members connected at upper ends thereof by a transverse header;

a door assembly mounted on the door frame at one of the designated vertical levels for gaining access to the carriage when the carriage is at the one designated vertical level, the door assembly including at least one door movable between open and closed positions relative to a doorway formed by the door frame at the one designated level;

a warning device including an elongated bar movably mounted between the vertical side members and automatically activated to move from a stored position to a warning position across the doorway upon movement of the at least one door of the door assembly to the open position when the carriage is located away from the one designated level;

a holding assembly mounted to the transverse header to hold the elongated bar in the stored position when the carriage is located at the one designated level and the at least one door is in either the open or closed position; and a support member mounted to the at least one door of the door assembly and positioned to support the elongated bar when the at least one door is in the closed position and the elongated bar is in the stored position and releases the elongated bar when the at least one door is in the open position.

14. The vertical reciprocating conveyor of claim 13 wherein the holding assembly is electrically activated to hold the elongated bar in the stored position when the door assembly is in the open position and the canine is located at the one designated level.

15. The vertical reciprocating conveyor of claim 14 wherein the holding assembly is electrically deactivated when the door assembly is in the closed position such that the support member holds the elongated bar in the stored position.

* * * * *